US009957762B2

(12) United States Patent
Marshall et al.

(10) Patent No.: US 9,957,762 B2
(45) Date of Patent: May 1, 2018

(54) FLUID DISTRIBUTION SYSTEM

(75) Inventors: James A. Marshall, Union, KY (US); Brian S. Carr, Burlington, KY (US); Michael A. Timmerman, Cincinnati, OH (US)

(73) Assignee: M-I L.L.C., Houston, TX (US)

( * ) Notice: Subject to any disclaimer, the term of this patent is extended or adjusted under 35 U.S.C. 154(b) by 4 days.

(21) Appl. No.: 12/921,088

(22) PCT Filed: Mar. 6, 2009

(86) PCT No.: PCT/US2009/036384

§ 371 (c)(1),
(2), (4) Date: Sep. 3, 2010

(87) PCT Pub. No.: WO2009/111730

PCT Pub. Date: Sep. 11, 2009

(65) Prior Publication Data

US 2011/0005742 A1 Jan. 13, 2011

Related U.S. Application Data

(60) Provisional application No. 61/034,555, filed on Mar. 7, 2008.

(51) Int. Cl.

| | |
|---|---|
| ***B07B 1/46*** | (2006.01) |
| ***E21B 21/06*** | (2006.01) |
| ***E21B 21/01*** | (2006.01) |
| ***B07B 13/16*** | (2006.01) |

(52) U.S. Cl.

CPC ..... *E21B 21/065* (2013.01); *B07B 13/16* (2013.01); *E21B 21/01* (2013.01); *B07B 1/46* (2013.01); *B07B 2201/04* (2013.01)

(58) Field of Classification Search

CPC . B07B 1/46; B07B 13/16; E21B 21/01; E21B 21/063; E21B 21/065

USPC ..... 209/254, 314, 315, 317, 920, 240, 243

See application file for complete search history.

(56) References Cited

U.S. PATENT DOCUMENTS

| | | | | |
|---|---|---|---|---|
| 2,995,245 | A * | 8/1961 | Van Tittelboom | 209/254 |
| 4,126,541 | A * | 11/1978 | Orzechowski | 209/240 |
| 4,382,858 | A | 5/1983 | Dudley | |
| 6,155,428 | A | 12/2000 | Bailey et al. | |
| 6,868,972 | B2 | 3/2005 | Seyffert et al. | |
| 6,910,587 | B2 | 6/2005 | Seyffert | |
| 7,350,590 | B2 * | 4/2008 | Hosie et al. | 166/386 |

(Continued)

FOREIGN PATENT DOCUMENTS

| | | | |
|---|---|---|---|
| GB | 703185 | A | 1/1954 |
| GB | 716527 | A | 10/1954 |
| GB | 2067099 | A | 7/1981 |

OTHER PUBLICATIONS

International Search Report from PCT/US2009/036384 dated Oct. 12, 2009 (2 pages).

(Continued)

*Primary Examiner* — Joseph C Rodriguez
*Assistant Examiner* — Kalyanavenkateshware Kumar
(74) *Attorney, Agent, or Firm* — David J. Smith

(57) ABSTRACT

A fluid distribution apparatus including a housing configured to receive a drilling material and direct the drilling material onto a separatory surface; and a damper coupled to the housing and configured to distribute a flow of the drilling material onto the separatory surface is disclosed.

5 Claims, 3 Drawing Sheets

(56) References Cited

U.S. PATENT DOCUMENTS

| | | | | |
|---|---|---|---|---|
| 7,740,761 | B2 * | 6/2010 | Bailey | 210/330 |
| 2004/0084189 | A1 | 5/2004 | Hosie et al. | |
| 2006/0144779 | A1 | 7/2006 | Bailey | |

OTHER PUBLICATIONS

Written Opinion from PCT/US2009/036384 dated Oct. 12, 2009 (3 pages).
Notification Concerning Transmittal of International Preliminary Report on Patentability and Written Opinion issued in related International Patent Application No. PCT/US2009/036384; dated Sep. 16, 2010 (5 pages).
Examination Report issued in corresponding Canadian Application No. 2,717,771; dated May 16, 2012 (3 pages).
Office Action issued in corresponding Chinese Application No. 200980108116.4; dated Sep. 7, 2012 (13 pages).
Office Action issued in corresponding Eurasian Application No. 201071046/31; with english translation dated Dec. 11, 2012 (2 pages).
Office Action issued in corresponding Canadian Application No. 2,717,771; dated Feb. 1, 2013 (3 pages).
Office Action issued in corresponding Chinese Application No. 200980108116.4 dated Aug. 22, 2013 (14 pages).
Office Action issued in corresponding Mexican Application No. MX/a/2010/009792 with English language communication reporting the same; dated Jul. 12, 2013 (7 pages).
Office Action issued in corresponding Chinese Application No. 200980108116.4; dated Apr. 11, 2013 and English translation thereof (15 pages).
Supplementary European Search Report issued in corresponding European Application No. 09718517.7; dated May 15, 2014 (7 pages).
Decision on Rejection issued in corresponding Chinese Application No. 2009801081164; dated Apr. 9, 2014 (18 pages).
Examiner's Report issued in corresponding Canadian Application No. 2717771 dated Nov. 15, 2013 (3 pages).
Official Action issued in corresponding Mexican Application No. MX/a/2010/009792 with English reporting thereof dated Nov. 21, 2013 (6 pages).
Reexamination Notification issued in Chinese Application No. 200980108116.4; dated Nov. 10, 2015 (13 pages).
Decision of Reexamination issued in Chinese Application No. 200980108116.4; dated Mar. 24, 2016 (36 pages).
Office Action issued in European Application No. 09718517.7; dated Mar. 3, 2016 (6 pages).
Office Action dated Feb. 28, 2017, issued by the Indonesia Patent Office in corresponding Indonesian Patent Application No. W-00201003437, with partial English translation (4 pages).
Reexamination Notification issued in corresponding Chinese Application No. 200980108116.4 dated Jun. 3, 2015 (16 pages).

* cited by examiner

FLUID DISTRIBUTION SYSTEM

BACKGROUND OF INVENTION

Field of the Invention

Embodiments of the present disclosure generally relate to apparatus and systems for distributing drilling material to a vibratory separator. In addition, embodiments disclosed herein relate to apparatus and systems for maximizing the efficiency of screening surfaces of vibratory separators.

Background Art

Oilfield drilling fluid, often called "mud," serves multiple purposes in the industry. Among its many functions, the drilling mud acts as a lubricant to cool rotary drill bits and facilitate faster cutting rates. Typically, the mud is mixed at the surface and pumped downhole at high pressure to the drill bit through a bore of the drill string. Once the mud reaches the drill bit, it exits through various nozzles and ports where it lubricates and cools the drill bit. After exiting through the nozzles, the "spent" fluid returns to the surface through an annulus formed between the drill string and the drilled wellbore.

Furthermore, drilling mud provides a column of hydrostatic pressure, or head, to prevent "blow out" of the well being drilled. This hydrostatic pressure offsets formation pressures, thereby preventing fluids from blowing out if pressurized deposits in the formation are breached. Two factors contributing to the hydrostatic pressure of the drilling mud column are the height (or depth) of the column (i.e., the vertical distance from the surface to the bottom of the wellbore) itself and the density (or its inverse, specific gravity) of the fluid used. Depending on the type and construction of the formation to be drilled, various weighting and lubrication agents are mixed into the drilling mud to obtain the right mixture. Typically, drilling mud weight is reported in "pounds," short for pounds per gallon. Generally, increasing the amount of weighting agent solute dissolved in the mud base will create a heavier drilling mud. Drilling mud that is too light may not protect the formation from blow outs, and drilling mud that is too heavy may over invade the formation. Therefore, much time and consideration is spent to ensure the mud mixture is optimal. Because the mud evaluation and mixture process is time consuming and expensive, drillers and service companies prefer to reclaim the returned drilling mud and recycle it for continued use.

Another significant purpose of the drilling mud is to carry the cuttings away from the drill bit at the bottom of the borehole to the surface. As a drill bit pulverizes or scrapes the rock formation at the bottom of the borehole, small pieces of solid material are left behind. The drilling fluid exiting the nozzles at the bit acts to stir-up and carry the solid particles of rock and formation to the surface within the annulus between the drill string and the borehole. Therefore, the fluid exiting the borehole from the annulus is a slurry of formation cuttings in drilling mud. Before the mud can be recycled and re-pumped down through nozzles of the drill bit, the cutting particulates must be removed.

Apparatus in use today to remove cuttings and other solid particulates from drilling fluid are commonly referred to in the industry as shale shakers or vibratory separators. A vibratory separator is a vibrating sieve-like table upon which returning solids laden drilling fluid is deposited and through which clean drilling fluid emerges. Typically, the vibratory separator is an angled table with a generally perforated filter screen bottom. Returning drilling fluid is deposited at the feed end of the vibratory separator. As the drilling fluid travels down the length of the vibrating table, the fluid falls through the perforations to a reservoir below, leaving the solid particulate material behind. The vibrating action of the vibratory separator table conveys solid particles left behind to a discharge end of the separator table. The above described apparatus is illustrative of one type of vibratory separator known to those of ordinary skill in the art. In alternate vibratory separators, the top edge of the separator may be relatively closer to the ground than the lower end. In such vibratory separators, the angle of inclination may require the movement of particulates in a generally upward direction. In still other vibratory separators, the table may not be angled, thus the vibrating action of the separator alone may enable particle/fluid separation. Regardless, table inclination and/or design variations of existing vibratory separators should not be considered a limitation of the present disclosure.

Accordingly, there exists a need for more efficient apparatus and systems for separating drilling materials.

SUMMARY OF INVENTION

In one aspect, the present invention relates to a fluid distribution apparatus comprising a housing configured to receive a drilling material and direct the drilling material onto a separatory surface; and a damper coupled to the housing and configured to distribute a flow of the drilling material onto the separatory surface.

Other aspects and advantages of the invention will be apparent from the following description and the appended claims.

DETAILED DESCRIPTION

In one aspect, embodiments disclosed herein relate to apparatus and systems for distributing drilling material to a vibratory separator. In particular, embodiments of the present disclosure provide a fluid distribution apparatus configured to couple to a vibratory separator and to direct and distribute a flow of drilling material onto a separatory surface of the vibratory separator. In another aspect, embodiments disclosed herein relate to apparatus and systems for maximizing the efficiency of screening surfaces of vibratory separators.

Figure 1:
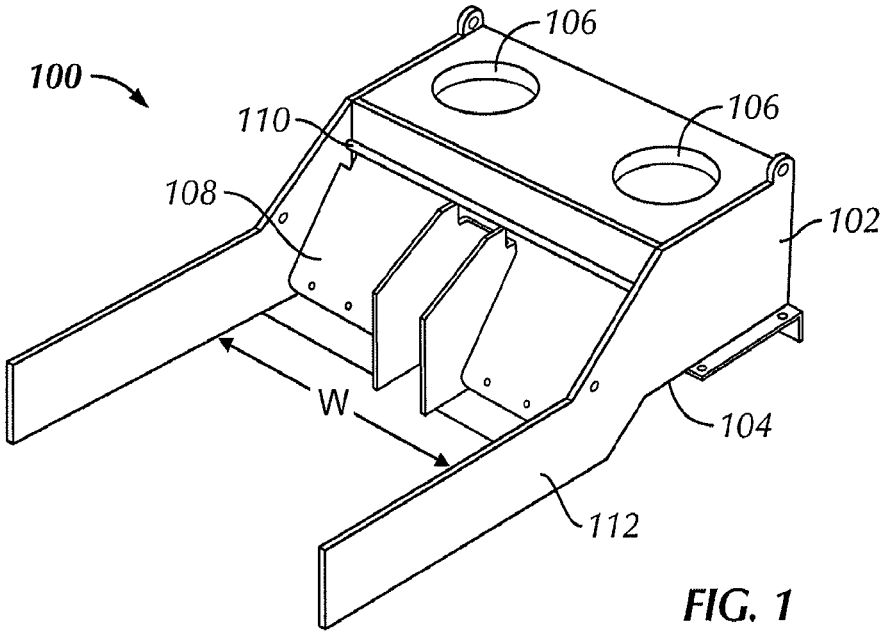
FIG. 1 is a perspective view of a fluid distribution apparatus in accordance with embodiments disclosed herein.
Figure 2:
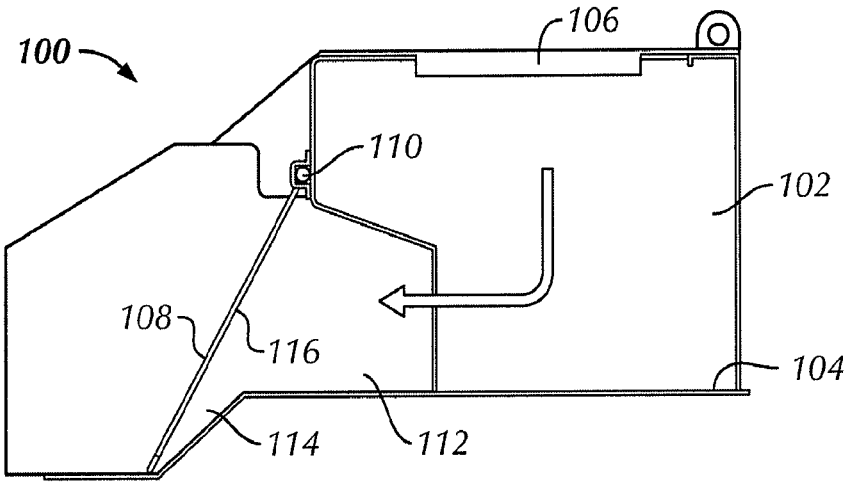
FIG. 2 is a cross-sectional view of the fluid distribution apparatus of FIG. 1.

Referring to FIGS. 1 and 2, a fluid distribution apparatus 100 is shown. The fluid distribution apparatus 100, or feeder, includes a housing 102 configured to couple to a feed end of a vibratory separator or shaker (not shown), a gumbo separator, or any other separatory system used for separating drilling fluids, drilling materials, muds, etc. The housing 102 includes a flat bottom surface 104 and at least one inlet 106. The at least one inlet 106 is configured to receive a flow of drilling material (e.g., drilling fluid, gumbo) and the housing 102 directs the flow of drilling material onto a separatory surface (e.g., a shaker deck, a screening assembly, etc.) of the separatory system. One of ordinary skill will appreciate that the inlet can be from the top, the back or the side, or in other locations as desired.

As shown, the fluid distribution apparatus 100 further includes a damper 108 coupled to the housing 102 and configured to distribute a flow of the drilling material onto the separatory surface. The damper 108 may be made of any material known in the art, for example, steel, composite material, and rubber. The damper 108 is configured to connect to the housing 102 above an opening on an exit end 112 of the housing 102. The damper 108 extends down from above the opening of the exit end 112 to close or cover the opening of the exit end 112 of the housing 102. In certain embodiments, the housing 102 may include a sloped exit 114 to facilitate the flow of drilling materials therefrom.

The damper 108 is connected to the housing 102 so as to control the flow of drilling material exiting the housing 102. Further, the damper 108 is configured to distribute the flow of drilling material across the separatory or screening surface (not shown). In particular, the configuration of the damper 108 is selected so as to evenly distribute the flow of drilling material across the width (W) of the fluid distribution apparatus and corresponding separatory surface on which the flow of drilling material is supplied.

The damper 108 is connected to the housing 102 by mechanical means. For example, as shown in FIGS. 1 and 2, the damper 108 is coupled to the housing by a pin-type hinge. Thus, a flow of drilling material through housing 102 applies a pressure to a first surface 116 of the damper 108. In this example, when the pressure applied by the flow of drilling material is greater than the pressure caused by the weight of the damper 108, the damper 108 rotates about the axis of the pin-type opening, thereby allowing drilling material to flow from the fluid distribution apparatus 100.

In an alternative embodiment, the damper 108 is coupled to the housing by a spring-loaded hinge. In this example, when the pressure applied by the flow of drilling material to the first surface 116 of the damper 108 is greater than the spring force of the spring-loaded hinge, the damper 108 rotates about the axis of the spring-loaded hinge, thereby allowing drilling material to flow from the fluid distribution apparatus 100.

Thus, the damper 108 may be configured to control the flow and distribution of the flow of drilling material by selecting, for example, the shape, design, and/or weight of the damper 108 and the connection means for coupling the damper 108 to the housing 102. For example, in one embodiment, the damper 108 may be connected to the housing 102 with a pin-type hinge. In this example, the damper 108 may be configured such that back pressure is created in the drilling material in the housing 102. The back pressure of the drilling material in the housing 102 causes the drilling material to distribute across the width (W) of the damper 108. Thus, when the pressure of the drilling material acting on the first surface 116 of the damper 108 overcomes the weight of the damper 108, the drilling material moves the damper 108 about the pin-type hinge axis. The resulting flow of drilling material exiting the fluid distribution apparatus 100 is, therefore, evenly distributed across the width (W) of the separatory surface or screening surface of the separatory separator.

In this embodiment, the damper 108 may be configured based on the expected fluid pressure in the fluid distribution apparatus 100 or the desired flow rate or drilling material distribution exiting the fluid distribution apparatus 100. In particular, the weight of the damper 108 used with a pin-type hinge connection to the housing 102 may be selected so as to provide sufficient back pressure on the drilling material in the fluid distribution device 100, and therefore an even distribution of drilling material across the width (W) of the damper 108. In one embodiment, detachable weights (not shown) may be attached to the damper 108 based on fluid pressure. For example, small weights may be fastened, by for example, mechanical fasteners, to the damper 108. Alternatively, small weights may be adhered to or welded to the damper 108. In other embodiments, the damper 108 may be formed of a thicker material, for example, a thicker metal, to provide more weight to counter the pressure of the drilling material in the housing 102. Thus, the design and configuration of the damper 108 may be selected so as to control the flow and distribution of drilling material across the separatory surface of the vibratory separator.

In the embodiment where the damper 108 is connected to the housing with a spring-loaded hinge, the spring may be selected such that the spring force creates sufficient back pressure on the drilling material in the fluid distribution apparatus 100 so that an even distribution of drilling material across the width (W) of the damper 108 results. Thus, when the pressure of the drilling material on the first surface 116 of the damper 108 overcomes the spring force, the drilling material exiting the fluid distribution apparatus 100 is evenly distributed across the width of the separatory surface of the vibratory separator.

Figure 3:
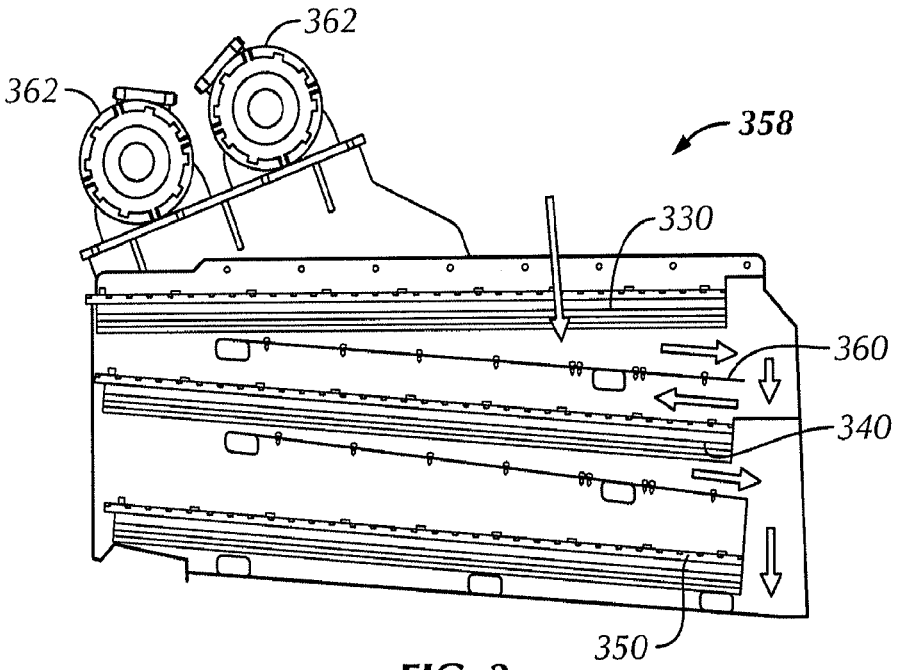
FIG. 3 is a cut-away side view of a vibratory separator in accordance with embodiments disclosed herein.

Referring now to FIG. 3, in one embodiment, the fluid distribution apparatus (100 in FIGS. 1 and 2) is coupled to a vibratory separator 358 that includes a top screening deck 330, a middle screening deck 340, and a bottom screening deck 350, is shown. At least one motor 362 is attached to the shaker to provide vibratory motion while separating solids from drilling fluid. A mesh screen (not shown) is provided on each of the screening decks in order to filter out solids of various sizes from the drilling fluid according to the size of the respective mesh. In some embodiments, the mesh screen may be part of screen assemblies disposed on the top, middle, and bottom screening decks 330, 340, 350. Those of ordinary skill in the art will appreciate that the present disclosure is not limited to any particular screen assembly or mesh screen arrangement.

A flow-back pan 360 is provided to distribute drilling fluid between the middle screening deck 340 and the bottom screening deck 350. For illustration purposes in FIG. 4, screen assemblies are removed from the vibratory separator to provide a view of the flow-back pan 360. Those having ordinary skill in the art will appreciate that the arrangement and assembly of flow-back pan 360 may vary without departing from the scope of the present disclosure.

Figure 4:
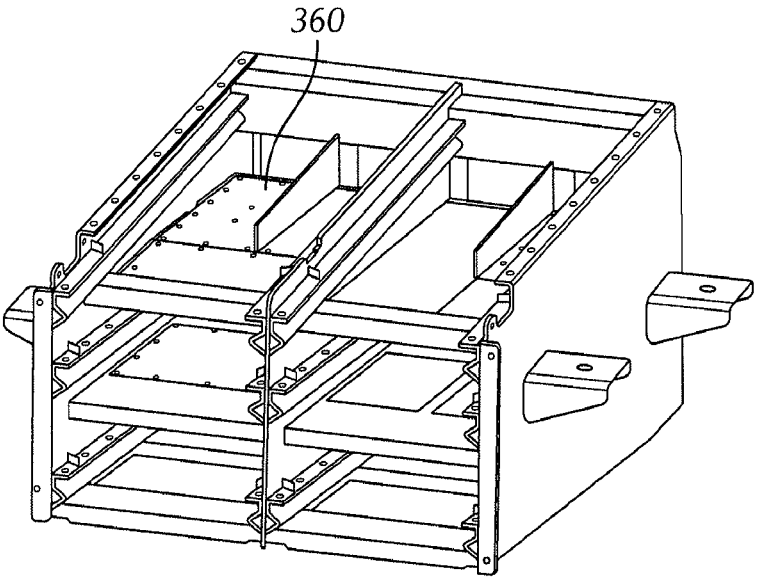
FIG. 4 is an assembly view of a shaker with different configurations of a rib in accordance with embodiments of the present disclosure.
Figure 5:
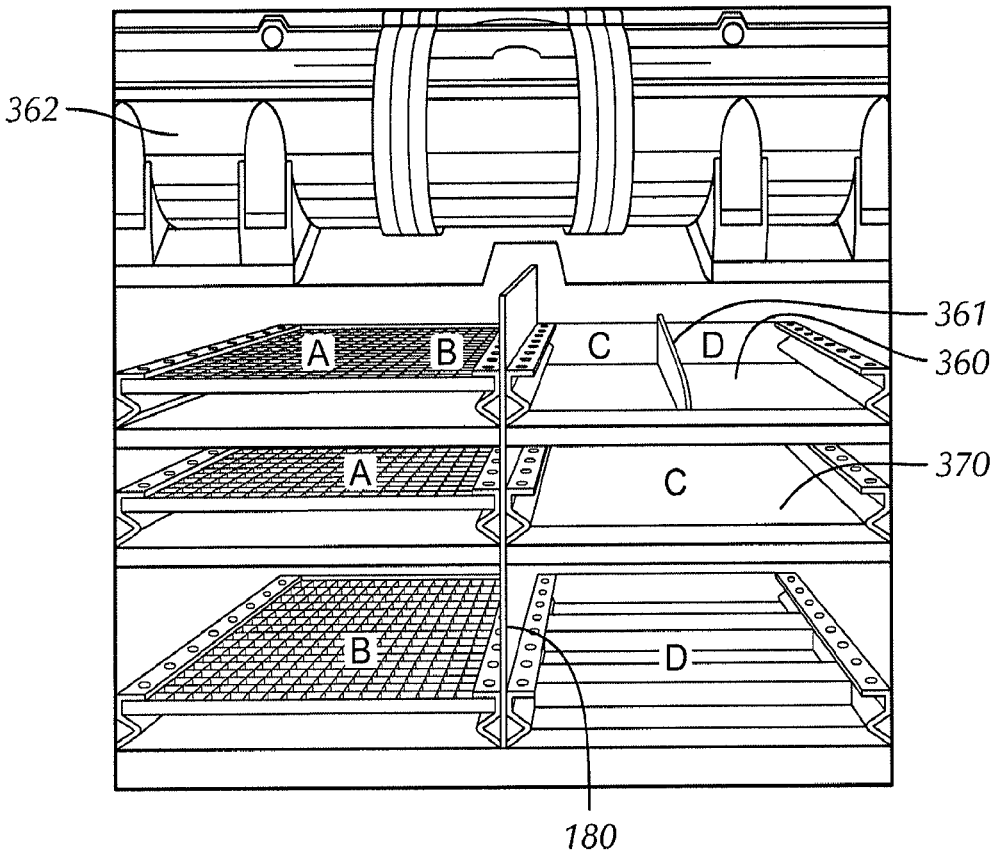
FIG. 5 shows a discharge end of a shaker in accordance with embodiments of the present disclosure.

Referring to FIGS. 4 and 5, flow-back pan 360 is disposed below top screening deck 330 and includes a plurality of channels for partitioning the flow of drilling fluid after initial separation of solids by top screening deck 330. In this particular embodiment, four channels (A, B, C, D) are included in the flow-back pan 360. The channels may be formed, for example, by providing a rib 361 between adjacent channels. Referring to FIG. 4, different configurations of rib 361 are shown in accordance with embodiments of the present disclosure. As shown, rib 361A extends along a full length of flow-back pan 360 and may be welded in place or secured with common fasteners. In alternate embodiments, rib 361B extends along only a portion of the entire length of flow-back pan 360, allowing a fluid to be more evenly distributed across flow-back pan 360 before being divided by rib 361B. Rib 361B may be welded onto a rear portion of flow-back pan 360. Those of ordinary skill in the art will appreciate that the channels may be formed in several ways without departing from the scope of the present disclosure. For example, either a full length rib 361A or a partial length rib 361B may be used in both compartments, or a combination of full length ribs 361A and short length ribs 361B may be used as shown. Further, in alternate embodiments, flow-back pan 360 may include upward bends between the channels to partition the channels from each other.

In this embodiment where the fluid distribution apparatus (100 in FIGS. 1 and 2) is coupled with a vibratory separator having flow-back pans with multiple channels, the fluid distribution apparatus advantageously provides more even distribution of drilling material on the separatory surface and, therefore, more even distribution of separated drilling material in each channel of the flow-back pans. Referring to FIGS. 1-5, the damper 108 provides sufficient back pressure on the drilling material in the fluid distribution apparatus 100, such that the drilling material is evenly distributed along the first surface 116 of the damper 108. When the pressure of the drilling material on the damper 108 overcomes the weight or spring force of the damper 108, the drilling material causes the damper 108 to rotate about the axis of the hinge 110, thereby allowing the drilling material to flow out on the top screening deck 330. Even distribution of the drilling material behind the damper 108, i.e., on the first surface 116 side of the damper 108, provides an even distribution of drilling material on the top screening deck 330. Therefore, the separated material collected in the channels of the flow-back pans 360 is similarly evenly distributed.

Even distribution of the drilling material on the screening deck and the channels of the flow-back pans of a vibratory separator maximizes the use of the screening surfaces on all deck levels of a multi-deck vibratory separatory. One of ordinary skill in the art will appreciate that other vibratory separators may be combined with a fluid distribution apparatus in accordance with embodiments disclosed herein, including vibratory separators having one screening deck, two screening decks, or more. Further, a fluid distribution apparatus in accordance with embodiments disclosed herein may be coupled with other separatory systems, including, for example, gumbo separators, to maximize the efficiency of the screening surface.

Advantageously, embodiments disclosed herein may provide a more efficient screening system. In particular, embodiments disclosed herein provide an apparatus for evenly distributing drilling material to a screening or separatory surface. As such, embodiments of the present disclosure may provide maximal use of the screening surfaces of a vibratory separator.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed:

1. A fluid distribution apparatus comprising:

a housing having a sloped exit, the housing configured to receive a drilling material and direct the drilling material onto a separatory surface; and a damper coupled to an exit end of the housing and configured to move in response to a fluid pressure of the drilling material;

the damper configured to create a back pressure on the drilling material in the housing, wherein the sloped exit comprises a first horizontal portion a first vertical distance from the separatory surface, a second horizontal portion a second vertical distance from the separatory surface, and a third portion sloped from the first portion toward the second portion, the second vertical distance less than the first vertical distance, and the damper positioned across at least a portion of the second portion.

2. The fluid distribution apparatus of claim 1, further comprising a hinge configured to couple the damper to the housing.

3. The fluid distribution apparatus of claim 1, wherein the hinge is selected from a group consisting of a pin-type hinge and a spring-loaded hinge.

4. The fluid distribution apparatus of claim 1, wherein the damper is formed from metal.

5. The fluid distribution apparatus of claim 1, further comprising a weight attached to the damper.

* * * * *